United States Patent [19]

Bonnice et al.

[11] Patent Number: 5,016,453

[45] Date of Patent: May 21, 1991

[54] TIMED REFRIGERATOR LOCK

[76] Inventors: Richard Bonnice, 1418 E. 52nd St., Brooklyn, N.Y. 11234; George Spector, 233 Broadway Rm. 3815, New York, N.Y. 10007

[21] Appl. No.: 584,694

[22] Filed: Sep. 19, 1990

[51] Int. Cl.[5] ..... E05B 65/00; E05B 43/00

[52] U.S. Cl. ..... 70/93; 70/268; 70/271

[58] Field of Search ..... 70/91, 93, 101, 267, 70/268, 269, 271, 274, 441, DIG. 49

[56] References Cited

U.S. PATENT DOCUMENTS 2,061,511 11/1936 Edmonds ..... 70/267

3,134,252 5/1964 Mintz ..... 70/93

4,548,060 10/1985 Campbell ..... 70/91

*Primary Examiner*—Robert L. Wolfe

[57] ABSTRACT

A timer controlled lock operating device for a refrigerator or the like is provided and consists of a plate affixed to the side wall of the refrigerator, a link chain having one end secured to the plate, a housing affixed to the front door of the refrigerator, a shackle extending from within the housing and engaging an opposite end of the link chain, and a mechanism within the housing for opening the shackle at a predetermined period of time so that a person can remove the link chain from the shackle and open the front door of the refrigerator to gain access therein to obtain food.

5 Claims, 1 Drawing Sheet

TIMED REFRIGERATOR LOCK

BACKGROUND OF THE INVENTION

The instant invention relates generally to locking devices and more specifically it relates to a timer controlled lock operating device for a refrigerator which provides a predetermined periods of time that a person is unable to gain access into the refrigerator to obtain food.

There are available various conventional locking devices which do not provide the novel improvements of the invention herein disclosed.

SUMMARY OF THE INVENTION

A primary object of the present invention is to provide a timer controlled lock operating device for a refrigerator that will overcome the shortcomings of the prior art devices. Another object is to provide a timer controlled lock operating device that will only open up at specific periods of time so that a person is able to gain access into the refrigerator to obtain food.

An additional object is to provide a timer controlled lock operating device that has a built in alarm to indicate that the lock is opened so that the chain can be removed to open the door of the refrigerator.

A further object is to provide a timer controlled lock operating device for a refrigerator that is simple and easy to use.

A still further object is to provide a timer controlled lock operating device for a refrigerator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
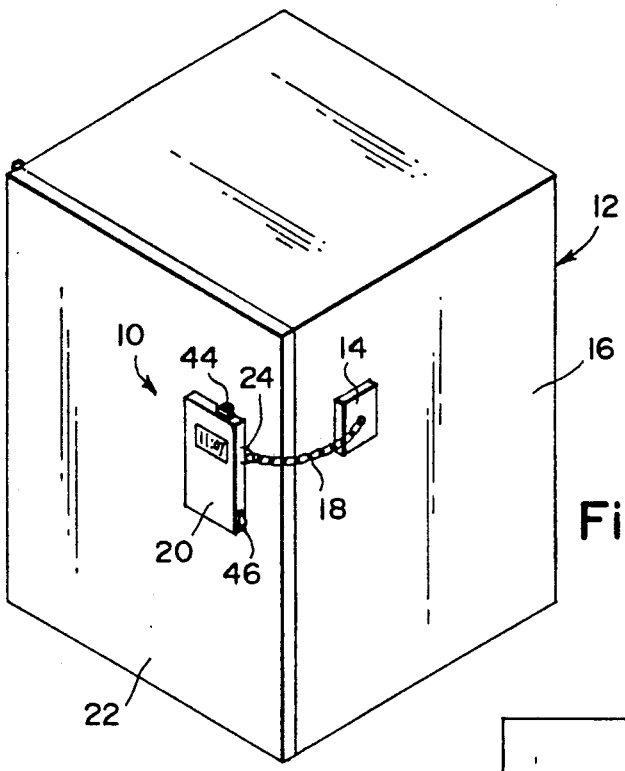
FIG. 1 is a perspective view of a refrigerator or the like with the instant invention mounted thereto.
Figure 2:
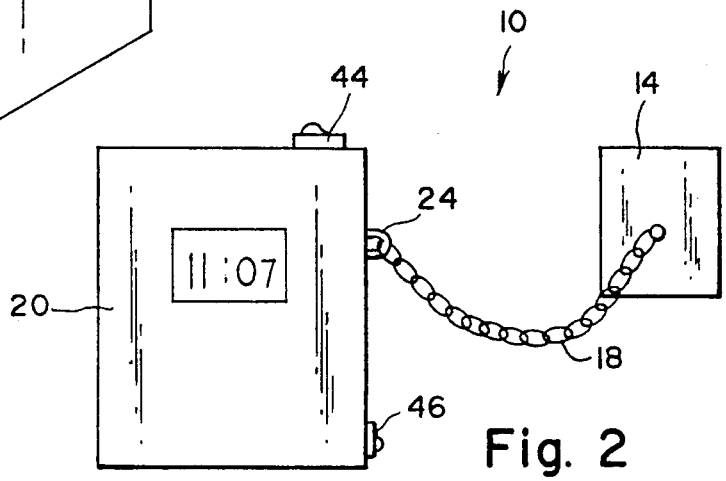
FIG. 2 is is a front view of the invention.
Figure 3:
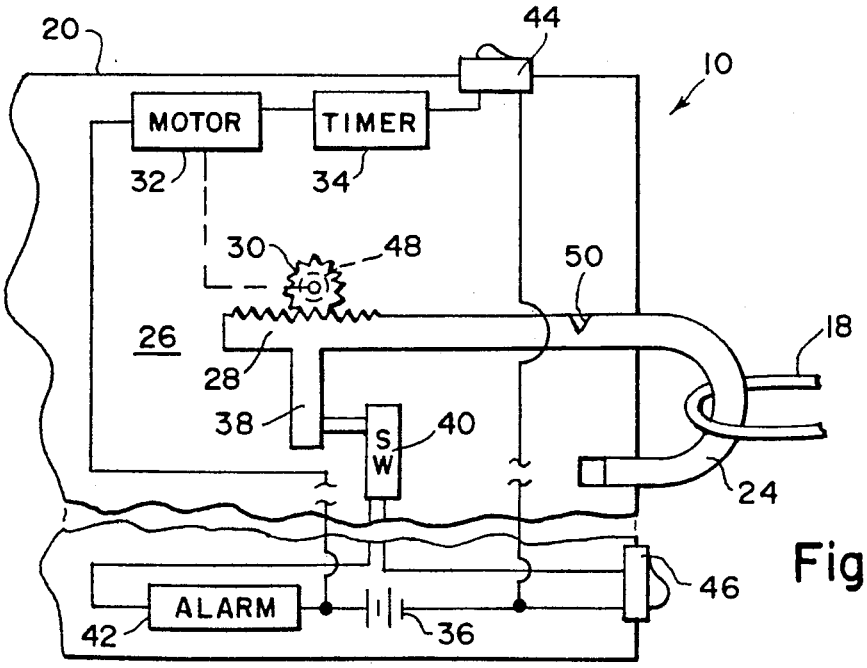
FIG. 3 is a diagrammatic cross section through the timer showing the electrical circuit and a fault in the shackle which will break if it is manually pulled out from the side of the timer.

Turning now descriptively to the drawings, in which similar reference characters denote similar elements throughout the several views, the FIGS. illustrate a timer controlled lock operating device 10 for a regrigerator 12 or the like consisting of a plate 14 affixed by adhesive to the side wall 16 of the refrigerator 12, a link chain 18 having one end secured to the plate 14 and a housing 20 affixed by adhesive to the front door 22 of the refrigerator 12 and a shackle 24 extends from within the housing 20 and engaging an opposite end of the link chain 18.

A mechanism 26 is within the housing 20 for opening the shackle 24 at a predetermined period of time so that a person can remove the link chain 18 from the shackle

24 and open the front door 22 of the refrigerator 12 to gain access therein to obtain food.

The opening mechanism 26 includes a rack 28 formed on the shackle 24, a pinion gear 30 engagable with the rack 28, a motor 32 mechanically connected to the pinion gear 30, a timer 34 electronically connected to the motor 32, and a battery 36 electronically connected to the timer 34 and the motor 32. The timer 34 can operate the motor 32 for specific periods of time so as to open and close the shackle 24 via the rack and pinion gear 30.

The opening mechanism 26 further includes an actuating arm 38 carried on the rack 28 of the shackle 24, a microswitch 40 activated by the movement of the actuating arm 38 and an alarm42 electronically connected between the microswitch 40 and the battery 36 which will be activated when the shackle 24 is opened. A first on-off switch 44 is electrically connected between the timer 34 and the battery 36 so that the timer 34 can be turned on and off. The second on-off switch 46 is electrically connected between the alarm 42 and the battery 36 so that the alarm 42 can be turned on and off. A manually operated clutch 48 is connected to the pinion gear 30 for resetting the shackle 24 in a locked position. The shackle 24 has a fault 50 formed thereon so that if the shackle 24 is manually pulled out from the housing 20 beyond a substantial amount the shackle 24 will break away.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A timer controlled lock operating device for a refrigerator or the like comprising;

(a) a plate affixed to the side wall of the refrigerator;

(b) a link chain having one end secured to said plate;

(c) a housing affixed to the front door of the refrigerator;

(d) a shackle extending from within said housing and engaging an opposite end of said link chain; and (e) means within said housing for opening said shackle at a predetermined period of time so that a person can remove said link chain from said shackle and open the front door of the refrigerator to gain access therein to obtain food.

2. A timer controlled lock operating device as recited in claim 1, wherein said opening means includes;

(a) a rack formed on said shackle;

(b) a pinion gear engagable with said rack;

(c) a motor mechanically connected to said pinion gear;

(d) a timer electronically connected to said motor; and (e) a battery electronically connected to said timer and said motor so that said timer can operate said motor for specific periods of time so as to open and close said shackle via said rack and pinion gear.

3. A timer controlled lock operating device as recited in claim 2, wherein said opening means further includes:

(a) an actuating arm carried on said rack of said shackle;

(b) a microswitch activated by the movement of said actuating arm; and (c) an alarm electronically connected between said microswitch and said battery which will be activated when said shackle is opened.

4. A timer controlled lock operating device as recited in claim 3, wherein said opening means further includes:

(a) a first on-off switch electrically connected between said timer and said battery so that said timer can be turned on and off; and (b) a second on-off switch electrically connected between said alarm and said battery so that said alarm can be turned on and off.

5. A timer controlled lock operating device as recited in claim 4 wherein said opening means further includes:

(a) a manually operated clutch connected to said pinion gear for resetting said shackle in a locked position; and (b) said shackle having a fault formed thereon so that if said shackle is manually pulled out from said housing beyond a substantial amount said shackle will break away.

* * * * *